US006837684B2

(12) United States Patent
Ilves

(10) Patent No.: US 6,837,684 B2
(45) Date of Patent: Jan. 4, 2005

(54) PUMP IMPELLER

(75) Inventor: Lasse Ilves, Helsinki (FI)

(73) Assignee: Grundfos Management A/S, Bjerringbro (DK)

( * ) Notice: Subject to any disclaimer, the term of this patent is extended or adjusted under 35 U.S.C. 154(b) by 0 days.

(21) Appl. No.: 10/280,037

(22) Filed: Oct. 25, 2002

(65) Prior Publication Data

US 2004/0081557 A1 Apr. 29, 2004

(51) Int. Cl.[7] ..... F04D 29/22
(52) U.S. Cl. ..... 416/177
(58) Field of Search ..... 415/71, 72, 73; 416/176, 177

(56) References Cited

U.S. PATENT DOCUMENTS

| | | | | | |
|---|---|---|---|---|---|
| 8,759 | A | * | 2/1852 | Nott et al. | 415/71 |
| 538,050 | A | | 4/1895 | Swabel | |
| 2,272,469 | A | | 2/1942 | Lannert | |
| 2,655,868 | A | | 10/1953 | Lindau et al. | |
| 2,741,992 | A | * | 4/1956 | Glazebrook | 415/227 |
| 2,853,019 | A | | 9/1958 | Thornton | |
| 2,887,958 | A | | 5/1959 | Davidson | |
| 3,560,119 | A | * | 2/1971 | Busch et al. | 418/55.3 |
| 3,732,032 | A | | 5/1973 | Daneel | |
| 3,809,491 | A | | 5/1974 | Banyai | |
| 4,347,035 | A | | 8/1982 | Stahle | |
| 4,556,364 | A | * | 12/1985 | Barker | 415/172.1 |

FOREIGN PATENT DOCUMENTS

| | | | |
|---|---|---|---|
| CA | 2 253 067 | C | 6/2002 |
| CA | 2 254 187 | C | 7/2002 |
| DE | 470 221 | C | 1/1929 |
| DE | 714 289 | C | 11/1941 |
| DE | 1 196 506 | B | 7/1965 |
| DE | 32 11 230 | A | 9/1983 |
| DE | 32 35 079 | A1 | 3/1984 |
| DE | 34 44 907 | A1 | 6/1986 |
| EP | 0 359 731 | A1 | 3/1990 |
| GB | 574079 | B | 12/1945 |
| GB | 687514 | A | 2/1953 |
| SE | 426976 | | 2/1983 |

* cited by examiner

*Primary Examiner*—Ninh H. Nguyen
(74) *Attorney, Agent, or Firm*—Birch, Stewart, Kolasch & Birch, LLP

(57) ABSTRACT

An impeller for a pump used for pumping liquid substances, such as waste water, said impeller containing at least one flow channel of a spatially curved shape, wherein the flow channel is of an evenly curved shape and, in the final portion of the channel, the flow channel meets itself, or another channel if the impeller has more than one flow channel. By using the impeller of the invention, a very high efficiency is achieved.

2 Claims, 2 Drawing Sheets

PUMP IMPELLER

Figure 1:
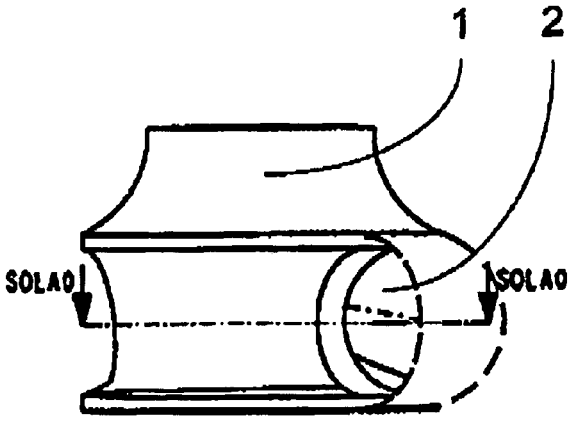

The present invention relates to an impeller for a pump used for pumping liquid substances, such as waste water, said impeller containing at least one flow channel of a spatially curved shape.

Prior-art impellers of centrifugal pumps designed for the pumping of liquids have a shield and a hub of a rotationally symmetrical structure and between them one or more blades of e.g. a spiral shape, serving to form one or more spatially curved flow channels in the impeller.

In addition to waste liquids, waste waters also contain solid waste, such as pieces of cloth and other solid bodies. In the pumping of waste water, these solid pieces cause interruptions in operation as well as power losses in the pumps because they may stick to the blades of the pump impeller or accumulate as lumps inside the impeller. For this reason, the flow channels of the impellers of waste water pumps are often so implemented that they have a large cross-sectional area to allow especially large solid bodies to pass through the channel without clogging the pump. Also, to achieve a more effective flow and to reduce the risk of clogging, the impeller blade may also be so shaped that it has a larger thickness in the middle than at the ends. Such an impeller is disclosed e.g. in SE specification 426976. It is also possible sharpen the leading edge of the impeller so that it will cut solid bodies of waste present in the waste water into smaller pieces, as described e.g. in U.S. Pat. No. 4,347,035.

In another prior-art impeller of a centrifugal pump intended for the pumping waste waters, the leading edges of the impeller blades have a strongly splayed form, making the pump less prone to be clogged. Such an impeller is disclosed e.g. in CA patent applications 2,254,187 and 2,253,067.

Because of the blades used in prior-art impellers, the liquid flowing into the impeller meets upon entering the impeller the edge of a blade and is divided into two separate liquid flows on opposite sides of the blade. This causes extra work and at the same time extra power consumption. In addition, pieces of solid waste may stick to the edge of the blade.

Specification DE 32 11 230 discloses a hollow impeller for a waste water pump, with a spiral flow channel formed in it.

Prior-art impellers have a relatively poor efficiency, and additionally pieces of solid waste may cause interruptions in operation and power losses.

The object of the invention is to eliminate the drawbacks of prior-art solutions and to achieve a completely new type of impeller for a pump used e.g. for the pumping of waste water, making it possible to achieve a simple construction and a substantially better efficiency than in prior-art impellers.

The structure of the pump impeller of the invention is based on the idea that, in the design of the pump impeller of the invention, instead of defining the shape of the blade between the shield and the hub as in the design of prior-art impellers, the shape of the flow channel is defined. This can be done by defining a spatially curved line, along which the cross-section is varied.

Figure 3:
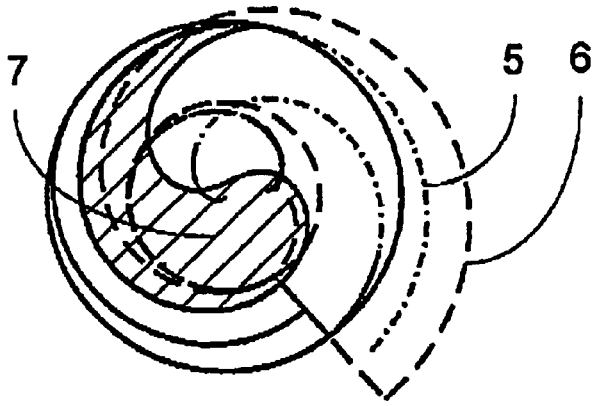

The impeller of the invention is characterized in that it has a uniformly continuous structure; in other words, it has no actual blade structure at all. In addition, the flow channel has an evenly curved shape, i.e. it has no abrupt bends due to blades or the like, and, unlike prior-art flow channels, at its end the flow channel meets itself or, in the case of an impeller with several channels, another channel, a structure resembling the trailing edge of a blade being formed at this meeting point. Due to this the cross section of the impeller as seen in FIG. 3 is of a droplet shape having a rather blunt round front edge and a wedge like trailing edge. Moreover, the cross-section of the channel remains constant or changes evenly without any sharp changes in shape and/or cross-sectional area. The details of the features characteristic of the impeller of the invention are presented in the claims below.

By applying the invention, it is possible to achieve waste water impellers that are nearly clog-proof and have a very high efficiency even when liquids containing solid bodies or fibers are pumped. The impeller has no blade and therefore no structure like the leading edge of a blade in the area of entry of the flow, and consequently no stagnation point is formed there as is typically formed at the leading edge of the blade in prior-art pumps, neither is any low pressure generated in the region of the suction port. Therefore, an impeller of this design also has good suction properties, and it is not prone to cavitation.

Figure 2:
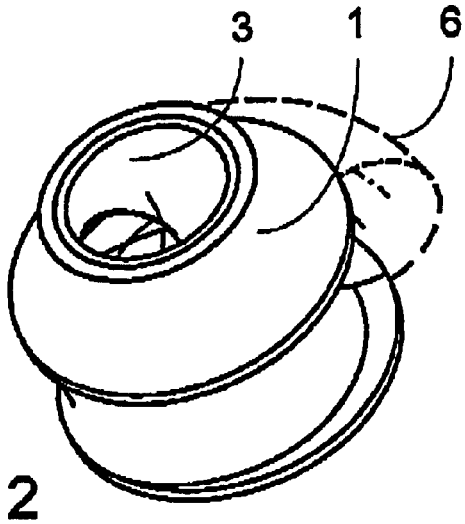
Figure 4:
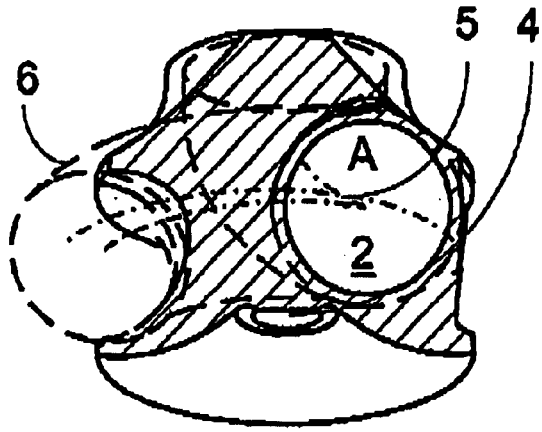
Figure 5:
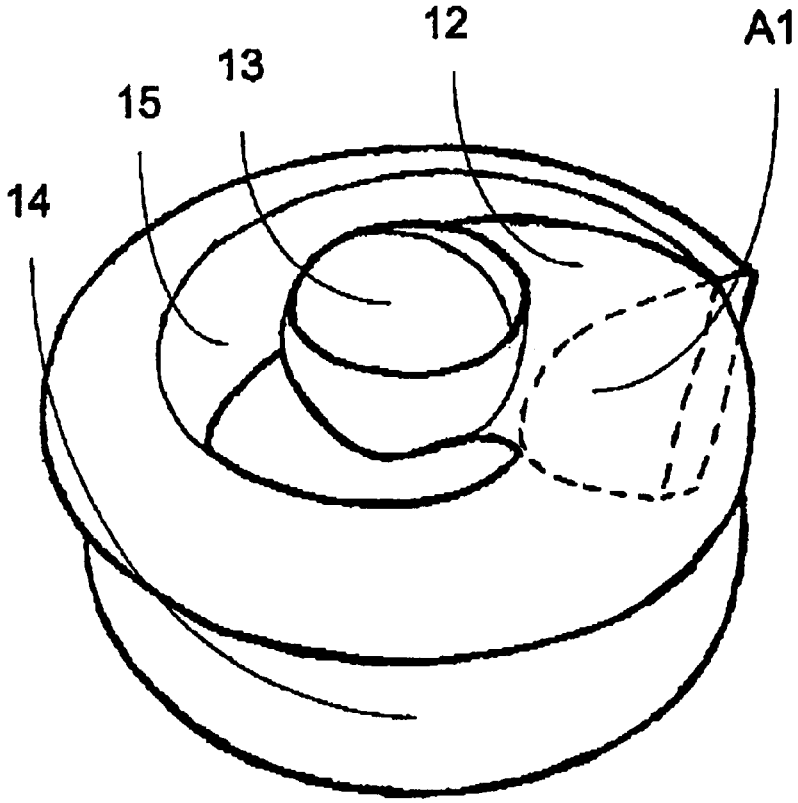

In the following, the invention will be described in detail by the aid of an example with reference to the attached drawings, wherein FIG. 1 presents a lateral view of an impeller according to the invention, FIG. 2 presents an oblique top view of an impeller according to the invention, and FIG. 3 presents an impeller according to the invention as a transverse cross-section SOLA0—SOLA0 of FIG. 1, FIG. 4 presents an impeller according to the invention in vertical cross-section taken at its middle, and FIG. 5 presents another impeller according to the invention.

FIGS. 1–4 present an impeller according to the invention for a centrifugal pump, especially one intended for the pumping of waste water. The impeller has a cast-metal body 1 provided with a spatially curved flow channel 2. At the upper end of the body 1 there is a circular suction port 3 of a size corresponding to the diameter of an intake waste water pipe, through which port the waste water is passed in from the waste water pipe. In addition, the impeller is provided with a hole 4 for a drive shaft going through it.

In the design of the impeller of the invention, the shape of the flow channel 2 is defined. This is done by giving a line 5 (dotted broken line) spatially curved in the direction of flow, along which is carried a constant or slowly changing cross-section A. The cross-section A may be of a circular form as in FIG. 4. Advancing along the curved line 5, the edge of the cross-section defines the edges 6 (broken line) of the flow channel 2 and also those of an imaginary extension of it as presented in the drawings.

The curved line 5 may be a spiral line such that it has at first a vertical portion at the center of the suction port 3, running in the direction of the center axis of the impeller, whereafter it begins to bend spatially into a spiral form. In the final portion of the channel, the curve forms a planar spiral. The line 5 has a spatial curvature, differing in this respect from planar curves. In addition, its curvature is gentle and continuous, i.e. its radius of curvature remains at least approximately the same all the time, so there are no sharp bends in the channel. The form and area of the cross-section A of the channel may change evenly and continuously, differing from prior-art solutions in this respect, too. Thus, the waste water flows continuously in the direction of the channel. As the flow channel spiralling on finally meets itself, or another channel if several channels are provided, a structure resembling the trailing edge of a blade is formed at this point. As illustrated in FIG. 3, the wall 7 between different parts of the channel 2 is relatively thick in the middle of the impeller. This leads to a cross section of the impeller as seen in FIG. 3 that is of a droplet shape having a rather blunt round front edge and a wedge like trailing edge.

Moreover, the body 1 has a uniformly continuous structure without separate structures, such as shield, hub or blade structures.

FIG. 5 presents another impeller according to the invention, designed especially for a centrifugal pump intended for the pumping of waste water. It has a cast-metal body containing a flow channel 12 spatially curved as in the case of FIGS. 1–4. At the upper end of the body there is a circular suction port 13 of a size corresponding to the diameter of an intake waste water pipe, through which port the waste water is passed from the waste water pipe. In addition, the impeller is provided with a through hole for a drive shaft. In this solution, the cross-section A1 of the flow channel changes from a substantially circular form to a form such that the outer wall 14 of the flow channel is substantially straight at the point where the channel meets itself, so the cross-section of the channel has the shape of letter D (see FIG. 5), whereafter the inner edge 15 also begins to straighten out, being also straight at the end of the channel, the cross-section of the channel thus having a rectangular form.

It is obvious to the person skilled in the art that different embodiments of the invention are not limited to the examples described above, but that they may be varied within the scope of the claims presented below.

What is claimed is:

1. An impeller for a pump used for pumping liquid substances, said impeller containing at least one flow channel of a spatially curved shape, wherein the flow channel is of an evenly curved shape, and that, in the final portion of the flow channel, the flow channel meets itself, or another channel if the impeller has more than one flow channel, wherein the cross-section of the flow channel changes from a substantially circular form into a form such that at least the outer wall of the flow channel is substantially straight in the final portion.

2. The pump impeller according to claim 1, characterized in that inner wall, too, of the flow channel is substantially straight in the final portion of the flow channel, especially at the end of the flow channel, so that the cross-section of the flow channel in the final portion is substantially rectangular.

* * * * *